US009070499B2

(12) United States Patent
Hou et al.

(10) Patent No.: US 9,070,499 B2
(45) Date of Patent: Jun. 30, 2015

(54) LIGHT EMITTING KEY

(71) Applicant: Universal Cement Corporation, Taipei (TW)

(72) Inventors: Chih-Sheng Hou, New Taipei (TW); Chia-Hung Chou, New Taipei (TW); Yann-Cherng Chern, New Taipei (TW)

(73) Assignee: UNIVERSAL CEMENT CORPORATION, Taipei (TW)

( * ) Notice: Subject to any disclaimer, the term of this patent is extended or adjusted under 35 U.S.C. 154(b) by 226 days.

(21) Appl. No.: 13/893,825

(22) Filed: May 14, 2013

(65) Prior Publication Data

US 2014/0340189 A1 Nov. 20, 2014

(51) Int. Cl.
*H01C 10/12* (2006.01)
*H01H 13/02* (2006.01)

(52) U.S. Cl.
CPC ..... *H01C 10/12* (2013.01); *H01H 13/023* (2013.01)

(58) Field of Classification Search
CPC ..... H01C 10/12
See application file for complete search history.

(56) References Cited

U.S. PATENT DOCUMENTS

| | | | | | |
|---|---|---|---|---|---|
| 4,772,769 | A * | 9/1988 | Shumate | 200/314 |
| 5,242,863 | A * | 9/1993 | Xiang-Zheng et al. | 438/53 |
| 5,485,359 | A * | 1/1996 | Galvin | 362/109 |
| 5,573,107 | A * | 11/1996 | Nakano et al. | 200/314 |
| 5,828,289 | A * | 10/1998 | Burgess | 338/47 |
| 6,026,283 | A * | 2/2000 | Stephenson | 455/575.1 |
| 7,068,142 | B2 | 6/2006 | Watanabe et al. | |
| 8,228,162 | B2 * | 7/2012 | Yoshihara et al. | 338/47 |
| 8,692,646 | B2 * | 4/2014 | Lee et al. | 338/47 |
| 2013/0063387 | A1 * | 3/2013 | Takai et al. | 345/173 |
| 2014/0340189 | A1 * | 11/2014 | Hou et al. | 338/198 |

* cited by examiner

*Primary Examiner* — James Harvey
(74) *Attorney, Agent, or Firm* — Lowe Hauptman & Ham, LLP

(57) ABSTRACT

A light emitting key is disclosed. A through hole is made through piezoresistive layer; a light source is arranged under the bottom of the light emitting key. When the light source is turned on, light beams shall emit out of the top substrate. The light emitting effect of the key facilitates it to be used in a dark area such as an aircraft flying in the night sky.

17 Claims, 11 Drawing Sheets

LIGHT EMITTING KEY

BACKGROUND

1. Technical Field

The present invention relates to a light emitting key which can be used in a key board or a key pad. The lighting effect facilitates the key board or key pad to be operable visibly in a dark area such as an aircraft flying in the night time.

2. Description of Related Art

FIG. 1 is a prior art

FIG. 1 is a prior art of U.S. Pat. No. 7,068,142. It disclosed a pressure-sensitive sensor 1 which includes first and second base films 2 serving as base materials, a pair of electrodes 3 formed on the respective base films 2, pressure-sensitive resistors 4 formed on the respective electrodes 3 and a spacer 6 for setting a predetermined gap 5 between the pressure-sensitive resistors 4. The deficiency for the prior art is that the pressure-sensitive sensor 1 can not be seen clearly in a dark environment. The invisibility of the sensor prevents it from being operable in a dark area. A light emitting key that can be operated visibly in a dark area is desired.

DETAILED DESCRIPTION OF THE INVENTION

This invention discloses a light emitting key. A through hole or ditch is made through the piezoresistive layer of the light emitting key. A light source, such as a light emitted diode or a light panel, is configured under the bottom of the light emitting key. The light beam emitted from the light source is able to pass the through hole or ditch to emit light beams on a top substrate of the light emitting key so that the light emitting key can be operated visibly in a dark environment. Several different structures of a single analog key is introduced in the present invention.

Figure 1:
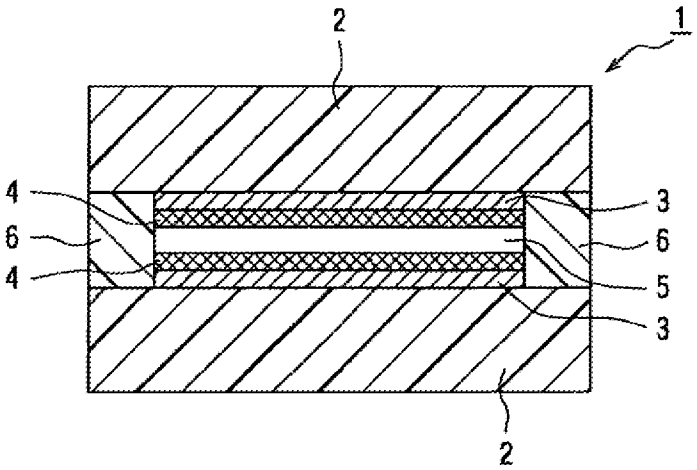
Fig.1 Prior Art
FIG. 1 is a prior art
Figure 2:
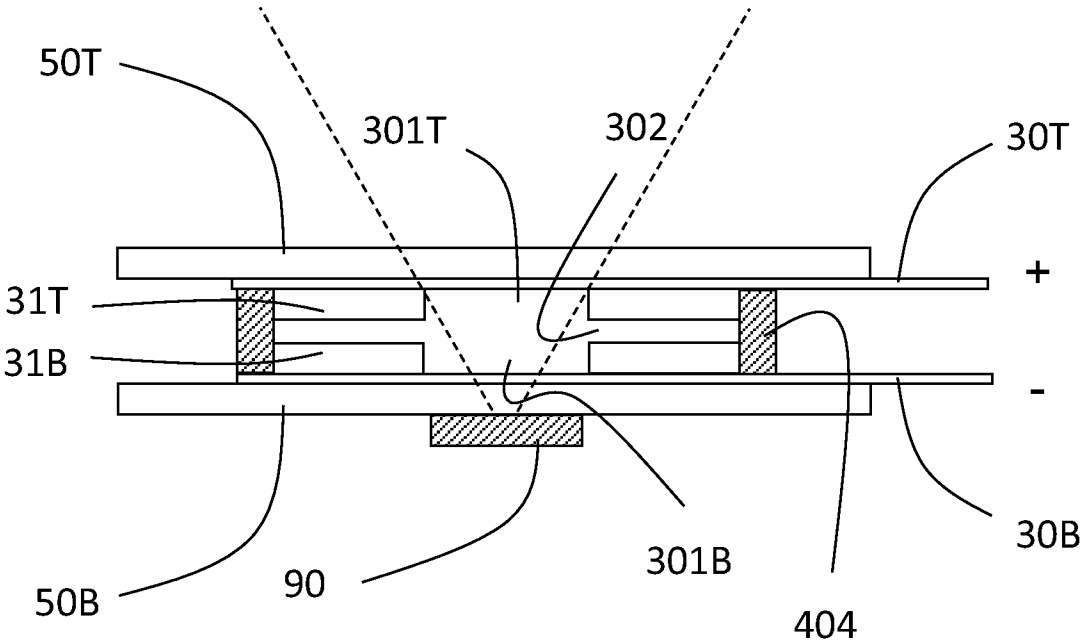
FIG. 2 shows a first embodiment of a light emitting key according to the present invention.

FIG. 2 shows a first embodiment of a light emitting key according to the present invention.

FIG. 2 shows a section view of a first embodiment for a light emitting key. A top transparent substrate 50T is prepared. A top electrode 30T is configured under the top substrate 50T. A top piezo piezoresistive layer 31T is configured on a bottom of the top electrode 30T. A bottom piezoresistive layer 31B is configured under the top piezoresistive layer 31T but maintains a space 302 therebetween. A bottom electrode 30B is configured on a bottom of the bottom piezoresistive layer 31B. A top through hole 301T is made through the top piezoresistive layer 31T. A bottom through hole 301B is made through the bottom piezoresistive layer 31B. A pair of spacers 404 is configured between the top electrode 30T and the bottom electrode 30B so that the gap 302 is formed between the top piezoresistive layer 31T and the bottom piezoresistive layer 31B. A bottom substrate 50B is configured on the bottom of the bottom electrode 30B. A light source 90, such as a light emitted diode or a light panel, is configured under the bottom substrate 50B.

The top substrate 50T and the top electrode 30T, the bottom substrate 50B and the bottom electrode 30B, are all made of transparent material. A transparent flexible circuit board which has transparent electric conductive traces is good for use to play a role of either a combination of the top substrate 50T plus the top electrode 30T or a combination of the bottom substrate 50B and the bottom electrode 30B in the present invention.

When the light emitting key of FIG. 2 is pressed, the two piezoresistive layer 31T, 31B are contacted and then compressed. The higher the pressure is, the thinner the total thickness becomes. According to the Law of Resistance ($R=\rho L/S$). The output resistance R decreases in proportion to the compressed total thickness L of the piezoresistive layer 31T and 31B. That is to say, an output resistance decreases with an increase of the pressure P. A corresponding analog signal can be output through the top electrode 30T and the bottom electrode 30B.

Figure 3:
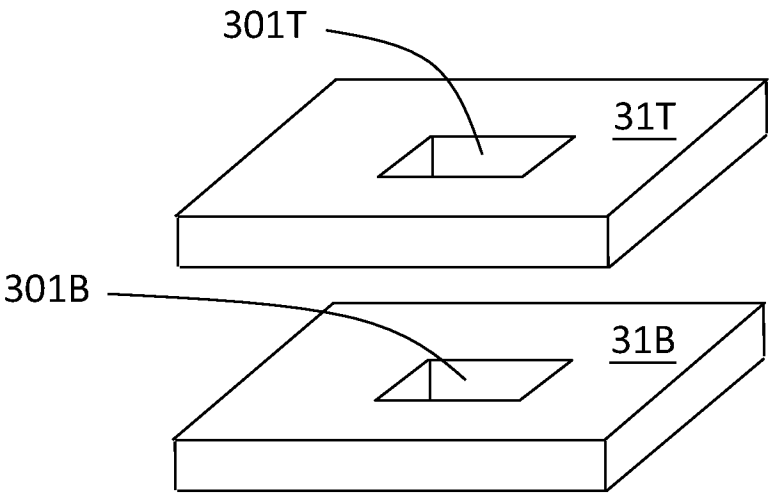
FIG. 3 shows an elevation view of the piezoresistive layers of FIG. 2

FIG. 3 shows an elevation view of the piezoresistive layers of FIG. 2

A rectangular top through hole 301T is made through the top piezoresistive layer 31T; and a rectangular bottom through hole 301B aligned with the top through hole 301T is made through the bottom piezoresistive layer 31B. A light source 90 is then arranged under the bottom of the light emitting key so that light beams are able to pass through the through hole 301T, 301B and emitted on the top substrate of the light emitting key of FIG. 2.

Figure 4:
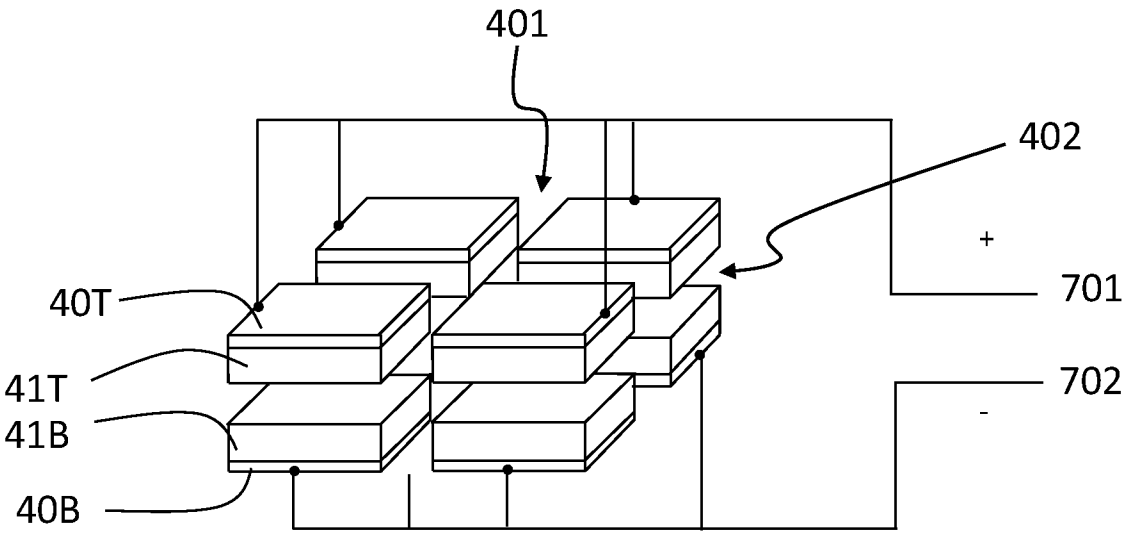
FIG. 4 shows a second embodiment of a light emitting key according to the present invention

FIG. 4 shows a second embodiment of a light emitting key according to the present invention FIG. 4 shows a light emitting key having a cruciform ditch 401 made through the top electrode 40T, the top piezoresistive layer 41T, the bottom piezoresistive layer 41B, and the bottom electrode 40B. In this embodiment, four top stacks and four bottom stacks occupy the outer four corners of the cruciform ditch 401. The four top electrodes 40T of the four top stacks are electrically coupled to a first electrode 701, say, a positive electrode. The four bottom electrodes 40B of the four bottom stacks are electrically coupled to a second electrode 702, say, a negative electrode. A light source 90 is then configured under the bottom to make the whole structure a single light emitting key.

Figure 5B:
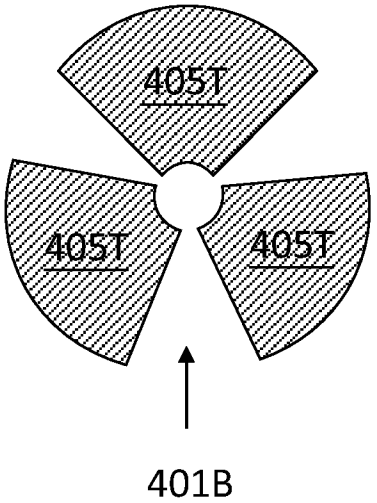
FIG. 5B shows a modified pattern of the piezoresistive layers
Figure 5A:
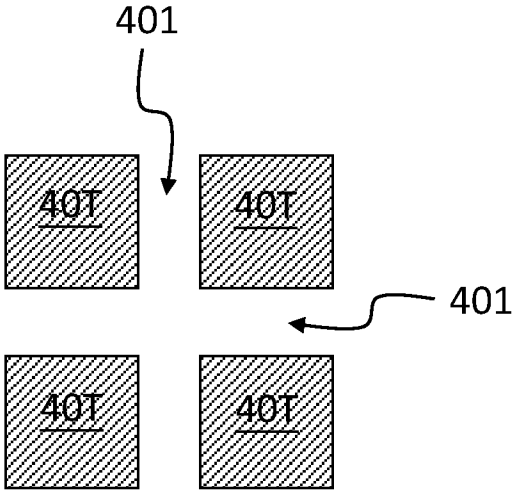
FIG. 5A shows a top view of FIG. 4

FIG. 5A shows a top view of FIG. 4

FIG. 5A shows that a cruciform ditch 401 is made for light emitting. Four stacks occupy the outer four corners of the cruciform ditch 401. Each block includes a top electrode 40T, top piezoresistive layer 41T, bottom piezoresistive layer 41B, and the bottom electrode 40B as shown in FIG. 4.

FIG. 5B shows a modified pattern of the piezoresistive layers

FIG. 5B shows the through ditch is made fan blade 401B for light emitting. Three fan stacks occupy the outer of the fan blade 401B. Each top electrode 405T of the three stacks is shown in the top view.

Figure 6A:
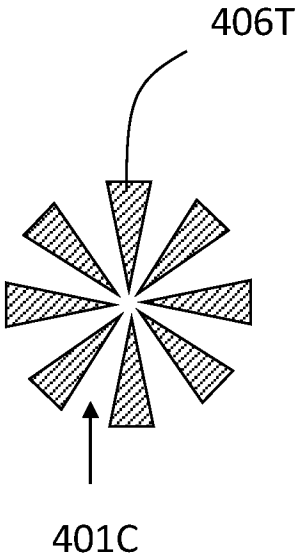
FIG. 6A shows a further modified pattern of the piezoresistive layers

FIG. 6A shows a further modified pattern of the piezoresistive layers

FIG. 6A shows the through ditch is made starburst 401C for light emitting. The remaining blocks are also starburst patterned. The top electrode 406T of the remaining blocks is shown in the top view.

Figure 6B:
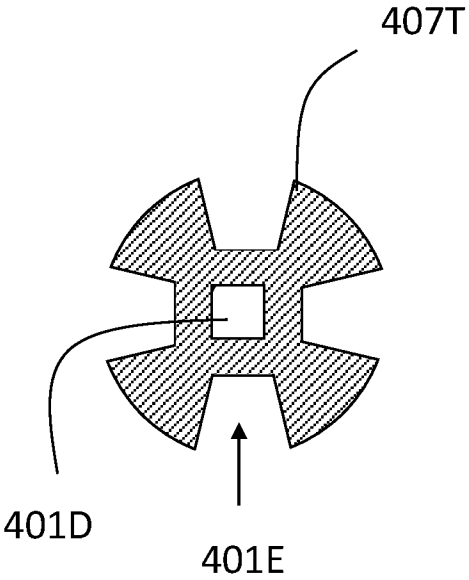
FIG. 6B shows a further modified pattern of the piezoresistive layers

FIG. 6B shows a further modified pattern of the piezoresistive layers

FIG. 6B shows a through hole 401D and four through cuts 401E are made for light emitting. The top electrode 407T of the remaining single stack is shown in the top view.

Figure 6C:
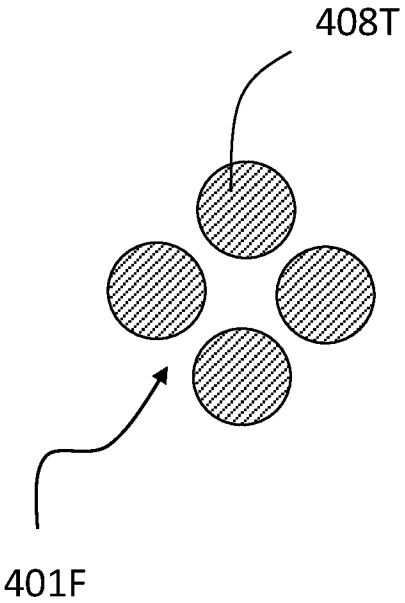
FIG. 6C shows a further modified pattern of the piezoresistive layers

FIG. 6C shows a further modified pattern of the piezoresistive layers

FIG. 6C shows a modified cruciform 401F is made for light emitting. The top electrode 408T is shown in this pattern. The remaining stacks are four columns patterned.

Figure 7:
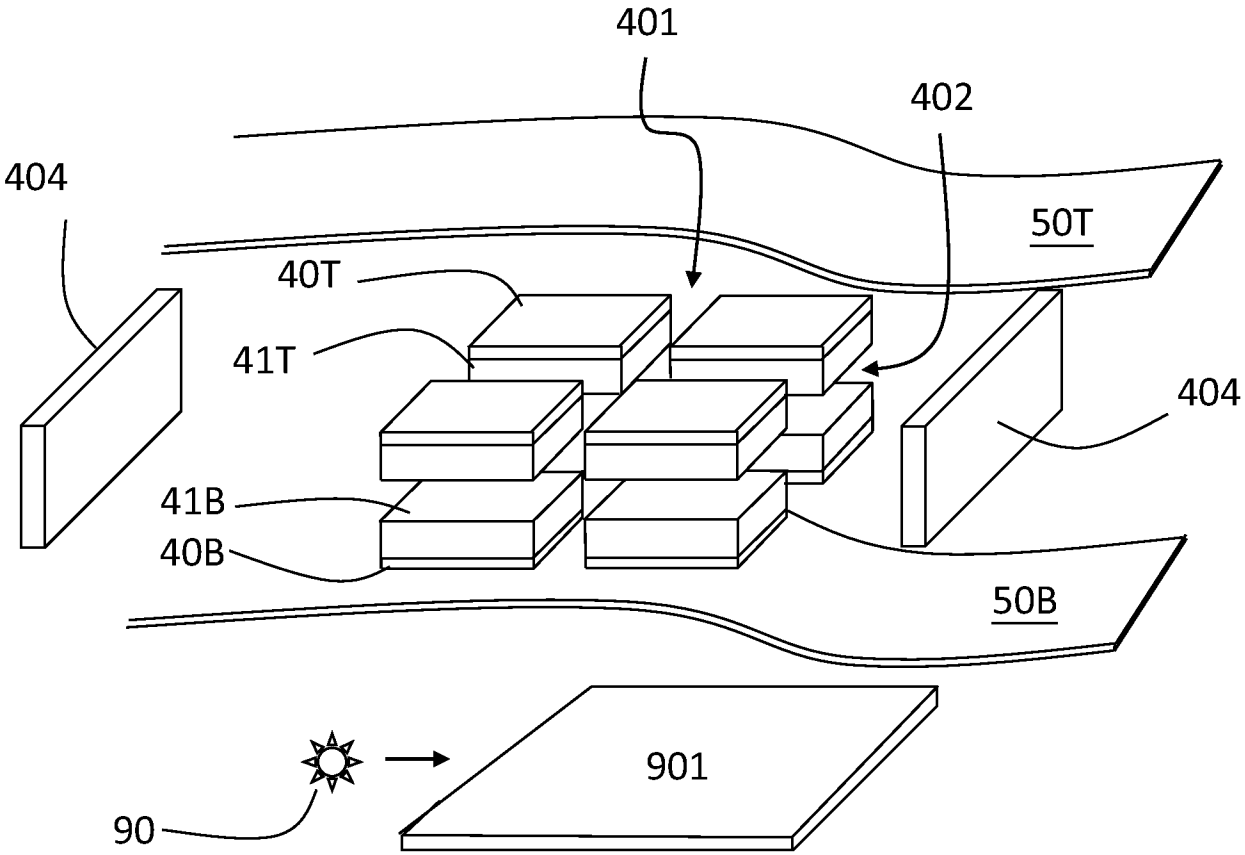
FIG. 7 shows an exploded view for a single key

FIG. 7 shows an exploded view for a single key

A flexible top substrate 50T is prepared; a top electrode 40T is made on a bottom side of the flexible top substrate 50T. A top piezoresistive layer 41T is made on a bottom side of the top piezoresistive layer 41T. A gap 402 is reserved under the top piezoresistive layer 41T. A bottom piezoresistive layer 41B is made under the gap 402. A bottom electrode 40B is made on a bottom side of the bottom piezoresistive layer 41B. A bottom flexible substrate 50B is made on a bottom side of the bottom electrode 40B. A light panel 901 is configured under the bottom substrate 50B. A light source 90, such as a light emitted diode, configured on a lateral side of the light panel 901. The light source 90 emits light beams to the light panel 901, the light panel 901 guides the light beams upward passing through the through ditch 401 to give off light beams and emits out of the top substrate 50T for the light emitting key. A pair of spacers 404 is configured between the top substrate 50T and the bottom substrate 50B for maintaining a space 402 between the top piezoresistive layer 41T and the bottom piezoresistive layer 41B.

Figure 8:
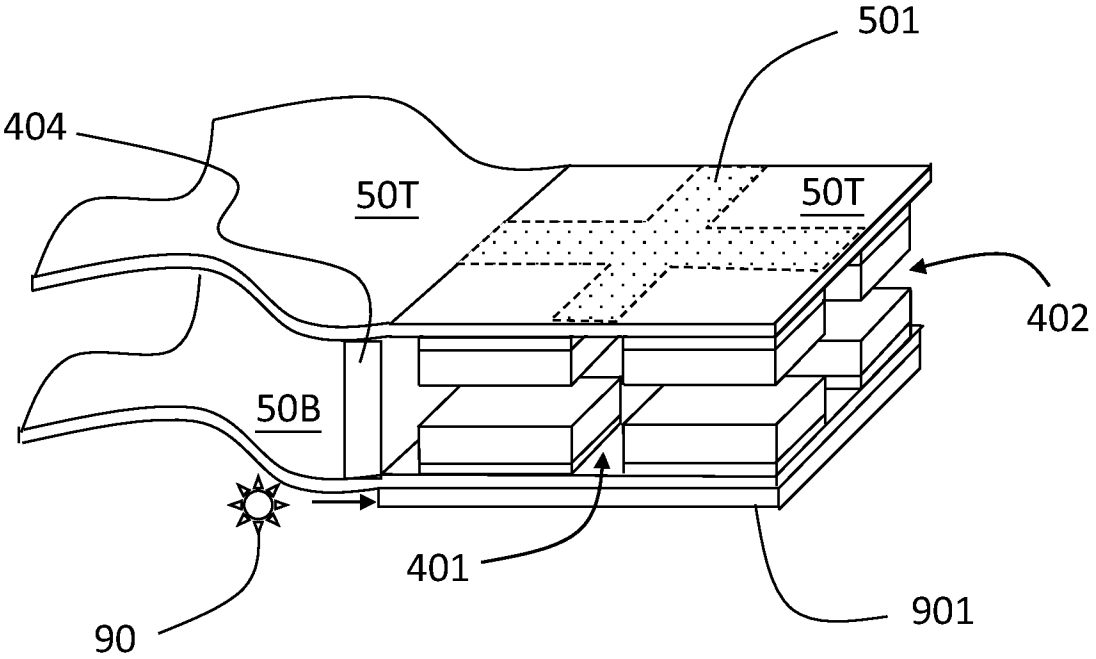
FIG. 8 is an assembly of FIG. 7

FIG. 8 is an assembly of FIG. 7

FIG. 8 shows when the light source 90 is turned on, light beams shall emit from area 501 of the top substrate 50T for an illumination of the key.

Figure 9:
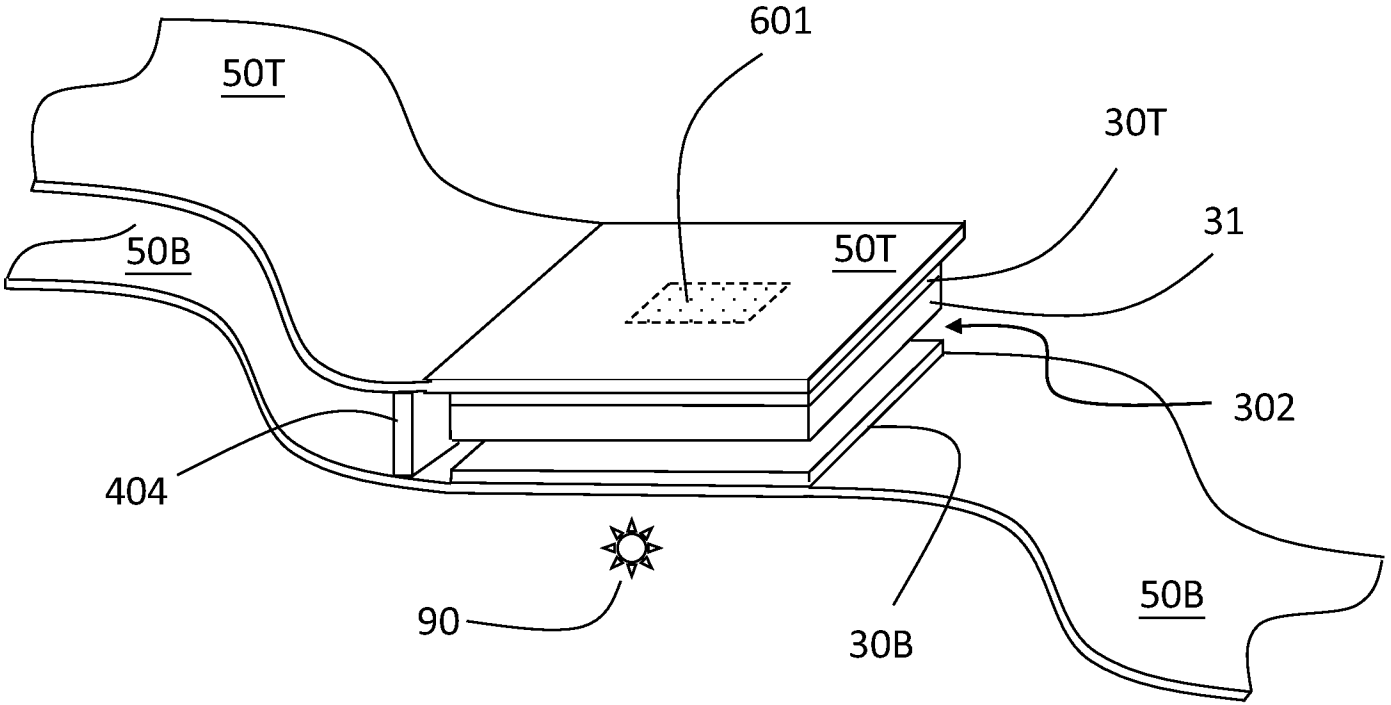
FIG. 9 shows a third embodiment of a light emitting key according to the present invention

FIG. 9 shows a third embodiment of a light emitting key according to the present invention FIG. 9 shows single piezoresistive layer 31 is used. The basic principle is the same as described above. A top substrate 50T is prepared. A top electrode 30T is made on a bottom of the top substrate 50T. A piezoresistor layer 31 is made on a bottom of the top electrode 30T. A gap 402 is reserved under the piezoresistive layer 31. A bottom electrode 30B is made under the gap 302. A bottom substrate 50B is made on a bottom of the bottom electrode 30B. A spacer 404 is configured between the top substrate 50T and the bottom substrate 50B. A light source 90, such as a light emitted diode (LED), is arranged under the bottom substrate 50B. A rectangular through hole is made through the piezoresistive layer 31. When the light emitted diode 90 is turned on, light beams shall emit from area 601 on the top substrate 50T.

The space 302 is made between the piezoresistive layer 31 and the bottom electrode 30B, this is for example only. Similarly, the space 302 can be made between the piezoresistive layer 31 and the top electrode 30T.

Figure 10:
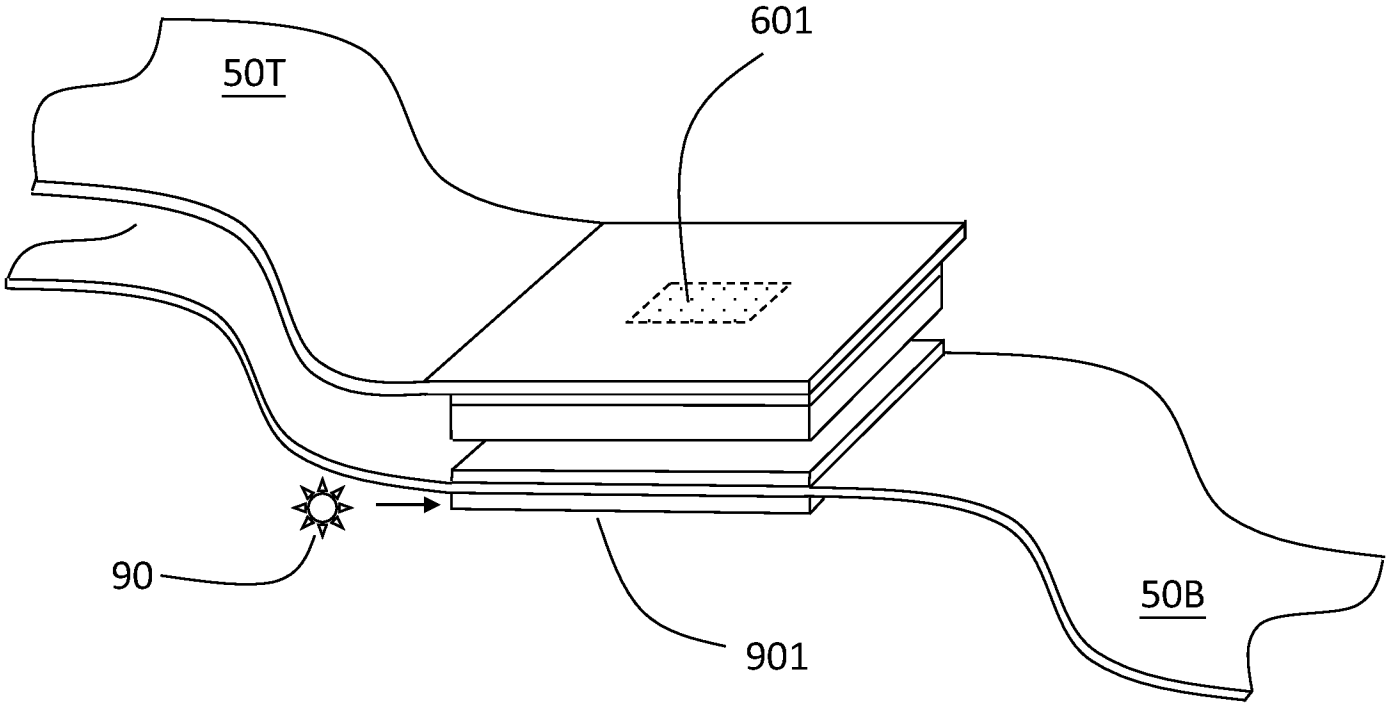
FIG. 10 shows a modified light source for FIG. 9

FIG. 10 shows a modified light source for FIG. 9

FIG. 10 shows that a light panel 901 is configured under the bottom substrate 50B. A light source 90, such as a light emitted diode, is arranged in a lateral side of the light panel 901. The light panel guides the light beams of the light source 90 upward, so that when the light source 90 is turned on, light beams emit from area 601 on the top substrate 50T.

Figure 11:
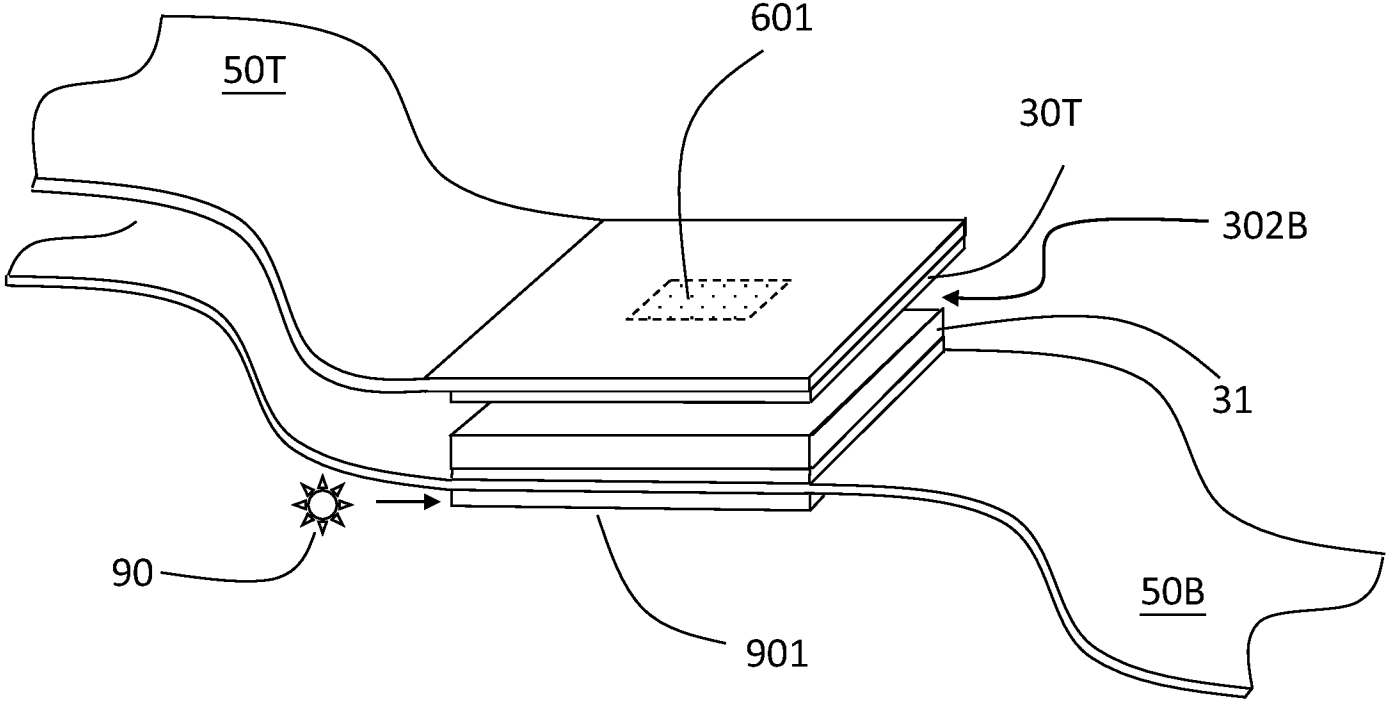
FIG. 11 shows a modified light emitting key for FIG. 10

FIG. 11 shows a modified light emitting key for FIG. 10

FIG. 11 is a structure similar to FIG. 10, the only difference is that the position of the gap 302B is different. FIG. 11 shows that the gap 302B is configured between the top electrode 30T and the piezoresistive layer 31.

While several embodiments have been described by way of example, it will be apparent to those skilled in the art that various modifications may be configured without departing from the spirit of the present invention. Such modifications are all within the scope of the present invention, as defined by the appended claims.

What is claimed is:

1. A light emitting key, comprising:

a top electrode;

a top piezoresistive layer, configured on a bottom of the top electrode;

a bottom piezoresistive layer, configured under the top piezoresistive layer;

a bottom electrode, configured on a bottom of the bottom piezoresistive layer;

a top through hole, made through the top piezoresistive layer;

a bottom through hole, made through the bottom piezoresistive layer; and a gap, reserved between the top piezoresistive layer and the bottom piezoresistive layer.

2. A light emitting key as claimed in claim 1, wherein each of the through holes, is made in a shape selected from a group consisted of rectangular, starburst, fan-blade, and cruciform.

3. A light emitting key as claimed in claim 1, further comprising:

a top substrate, configured on a top of the top electrode.

4. A light emitting key as claimed in claim 1, further comprising:

a bottom substrate, configured on a bottom of the bottom electrode 40B.

5. A light emitting key as claimed in claim 4, further comprising:

a spacer, configured between the top substrate and the bottom substrate.

6. A light emitting key as claimed in claim 4, further comprising:

a light source, configured on a bottom of the bottom substrate.

7. A light emitting key as claimed in claim 6, wherein the light source is a light emitted diode.

8. A light emitting key as claimed in claim 6, wherein the light source is a light panel.

9. A light emitting key, comprising:

a top electrode;

a piezoresistive layer, configured on a bottom of the top electrode;

a bottom electrode, configured under the piezoresistive layer;

a through hole, made through the piezoresistive layer; and a gap, reserved between the piezoresistive layer and the bottom electrode.

10. A light emitting key as claimed in claim 9, wherein the through holes is made in a shape selected from a group consisted of rectangular, starburst, fan-blade, and cruciform.

11. A light emitting key as claimed in claim 9, further comprising:

a top substrate, configured on a top of the top electrode.

12. A light emitting key as claimed in claim 9, further comprising:

a bottom substrate, configured on a bottom of the bottom electrode.

13. A light emitting key as claimed in claim 12, further comprising:

a spacer, configured between the top substrate and the bottom substrate.

14. A light emitting key as claimed in claim 12, further comprising:

a light source, configured on a bottom of the bottom substrate.

15. A light emitting key as claimed in claim 14, wherein the light source is a light emitted diode.

16. A light emitting key as claimed in claim 14, wherein the light source is a light panel.

17. A light emitting key, comprising:

a top electrode;

a piezoresistive layer, configured on a bottom of the top electrode;

a bottom electrode, configured under the piezoresistive layer;

a through hole, made through the piezoresistive layer; and a gap, reserved between the piezoresistive layer and the top electrode.

* * * * *